US006464804B2

(12) United States Patent
Goecmen et al.

(10) Patent No.: US 6,464,804 B2
(45) Date of Patent: Oct. 15, 2002

(54) MARTENSITIC-HARDENABLE HEAT-TREATED STEEL WITH IMPROVED RESISTANCE TO HEAT AND DUCTILITY

(75) Inventors: Alkan Goecmen, Baden-Dättwil; Peter Ernst, Stadel, both of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/848,322

(22) Filed: May 4, 2001

(65) Prior Publication Data

US 2002/0003008 A1 Jan. 10, 2002

(30) Foreign Application Priority Data

May 24, 2000 (DE) ..... 100 25 808

(51) Int. Cl.[7] ..... C22C 38/44; C22C 38/46; C21D 9/00

(52) U.S. Cl. ..... 148/325; 148/663; 420/38

(58) Field of Search ..... 148/325, 663; 420/38

(56) References Cited

U.S. PATENT DOCUMENTS

| | | | |
|---|---|---|---|
| 2,905,577 | A | 9/1959 | Harris, et al. |
| 5,415,706 | A | 5/1995 | Scarlin et al. |

FOREIGN PATENT DOCUMENTS

| | | | |
|---|---|---|---|
| DE | 19832430 | A1 | 2/1999 |
| EP | 0481378 | A1 | 4/1992 |
| EP | 0 688 883 | A1 | 12/1995 |
| EP | 0691412 | A1 | 1/1996 |
| EP | 0866145 | A2 | 9/1998 |
| EP | 0931845 | A1 | 7/1999 |
| GB | 741935 | | 12/1955 |
| JP | 5-263196 | | 10/1993 |
| JP | 8-225833 | | 9/1996 |

OTHER PUBLICATIONS

"Precipitation Bahaviour and Stability of Nitrides in High Nitrogen Martensitic 9% and 12% Chromium Steels", Geocmen, et al., ISIJ International, vol. 36, No. 7, 1996, pp. 768–776.

*Primary Examiner*—Deborah Lee
(74) *Attorney, Agent, or Firm*—Burns, Doane, Swecker & Mathis, L.L.P.

(57) ABSTRACT

The invention relates to a martensitic-hardenable heat-treated steel, having the following composition (data in % by weight): 9 to 13% Cr, 0.001 to 0.25% Mn, 2 to 7% Ni, 0.001 to 8% Co, at least one of W and Mo in total between 0.5 and 4%, 0.5 to 0.8% V, at least one of Nb, Ta, Zr and Hf in total between 0.001 and 0.1%, 0.001 to 0.05% Ti, 0.001 to 0.15% Si, 0.01 to 0.1% C, 0.12 to 0.18% N, at most 0.025% P, at most 0.015% S, at most 0.01% Al, at most 0.0012% Sb, at most 0.007% Sn, at most 0.012% As, remainder iron and customary impurities, and the proviso that the ratio by weight of vanadium to nitrogen V/N lies in the range between 3.5 and 4.2. After solution annealing at 1050 to 1250° C., cooling to a temperature below 300° C., tempering treatment, partial or complete reaustenitization at 600 to 900° C., cooling to a temperature below 300° C. and annealing at a temperature from 550 to 650° C., it has a high resistance to heat combined, at the same time, with a high ductility.

17 Claims, 5 Drawing Sheets

MARTENSITIC-HARDENABLE HEAT-TREATED STEEL WITH IMPROVED RESISTANCE TO HEAT AND DUCTILITY

This application claims priority under 35 U.S.C. §§ 119 and/or 365 to Appln. No. 100 25 808.5 filed in Germany on May 24, 2000; the entire content of which is hereby incorporated by reference.

The invention relates to martensitic-hardenable steels with high nitrogen contents. It relates to both the selection and the adaptation in terms of quantitative ratios of specific alloying elements which allow an extremely good combination of resistance to heat and ductility to be established, and to a process for the heat treatment of the alloy according to the invention.

Martensitic-hardenable steels based on 9–12% chromium are materials which are in widespread use in power plant engineering. It is known that the addition of chromium in the abovementioned range not only allows good resistance to atmospheric corrosion but also allows thick-walled forgings, as are used, for example, as monobloc rotors or as rotor disks in gas and steam turbines, to be hardened all the way through. Proven alloys of this type usually contain approximately 0.08 to 0.2% carbon, which in solution allows a hard martensitic structure to be established. A good combination of resistance to heat and ductility in martensitic steels is made possible by a tempering treatment, in which, as a result of the precipitation of carbon in the form of carbides with simultaneous recovery of the dislocation substructure, a particle-stabilized subgrain structure is formed. The tempering performance and the resultant properties can be actively influenced by the selection and the quantitative adaptation of specific carbide-forming elements, such as for example Mo, W, V, Nb and Ta.

Strengths of over 850 MPa in 9–12% chromium steels can be established by maintaining a low tempering temperature, typically in the range between 600 and 650° C. However, the use of low tempering temperatures leads to high transition temperatures from the brittle state to the ductile state (over 0° C.), with the result that the material exhibits a brittle fracture behavior at room temperature. Significantly improved ductilities can be achieved if the heat-treated strength is reduced to below 700 MPa. This is achieved by raising the tempering temperature to over 700° C. The use of higher tempering temperatures has the advantage that the microstructure states which are established are stable for longer periods at elevated temperatures. A typical representative which has found widespread use in steam power plants, in particular as rotor steel, is the German steel which is known under DIN as X20CrMoV12.1.

Furthermore, it is known that the ductility can be considerably improved at a strength level of 850 MPa by the addition of nickel to the alloy. For example, it is known that the addition of approximately 2 to 3% nickel to the alloy, even after tempering at temperatures of from 600 to 650° C., leads to a transition temperature from the brittle to the ductile state which lies below 0° C., so that overall it is possible to establish a significantly improved combination of strength and ductility. Alloys of this type are used wherever significantly higher demands are imposed both in terms of strength and in terms of ductility, typically as disk materials for gas turbine rotors. A typical representative of alloys of this type which has found widespread use in gas turbine technology, in particular as a material for rotor disks, is the German steel which is known under DIN as X12CrNiMo12.

In the past, various efforts have been made to improve specific properties of these steels. For example, the publication by Kern et al.: High Temperature Forged Components for Advanced Steam Power Plants, in Materials for Advanced Power Engineering 1998, Proceedings of the 6th Liège Conference, ed. by J. Lecomte-Becker et. al., has described the development of new types of rotor steels for steam turbine applications. In alloys of this type, the levels of Cr, Mo and W have been further optimized, taking account of approximately 0.03 to 0.07% N, 0.03 to 0.07% Nb and/or 50 to 100 ppm B, in order to improve the creep strength and creep rupture strength for applications at 600° C.

On the other hand, specifically for gas turbine applications, efforts have been made either to improve the creep rupture strengths in the range from 450 to 500° C. at a high ductility level or to reduce the tendency to become brittle at temperatures of between 425 and 500° C. For example, European patent application EP 0 931 845 A1 describes a nickel-containing 12% chromium steel, the constitution of which is similar to the German steel X12CrNiMo12, in which the element molybdenum is reduced compared to the known steel X12CrNiMo12 but a higher tungsten content is added to the alloy. DE 198 32 430 A1 has disclosed a further optimization of a steel which is of the same type as X12CrNiMo12 and is known as M152, in which, as a result of the addition of rare earth elements, the tendency to become brittle in the temperature range between 425 and 500° C. is restricted.

A drawback is that in none of the abovementioned developments was it possible to improve the strength, in particular the resistance to heat, at temperatures of between 300 and 600° C. to a similarly high ductility level to that of the steel X12CrNiMo12.

One possible approach with a view to improving the resistance to heat combined, at the same time, with a high ductility was proposed with the development of steels with high nitrogen contents. EP 0 866 145 A2 describes a new class of martensitic chromium steels with nitrogen contents in the range between 0.12 and 0.25%. In this class of steels, the overall microstructure formation is controlled by the formation of special nitrides, in particular of vanadium nitrides, which can be distributed in numerous ways by means of the forging treatment, by means of the austenitization, by means of a controlled cooling treatment or by means of a tempering treatment. While the strength is achieved by means of the hardening action of the nitrides, in this patent application it is desired to establish a high ductility through the distribution and morphology of the nitrides, but primarily by restricting the grain coarsening during the forging and during the solution annealing treatment. In the abovementioned document, this is achieved by both an elevated volumetric proportion and a high particle coarsening resistance of relatively insoluble nitrides, so that a close dispersion of nitrides was able to effectively limit the grain growth even at austenitization temperatures of from 1150 to 1200° C. The significant benefit of the alloys listed in EP 0 866 145 A2 lies in the possibility of optimally influencing the combination of strength and ductility solely through the formation of nitrides, with regard to distribution and morphology, by means of a suitable definition of the heat treatment.

However, an optimized formation of nitrides is only one factor involved in achieving a maximum ductility. A further factor of influence is to be expected from the action of dissolved substitution elements, such as nickel, cobalt and manganese. It is known that manganese in carbon steels tends to have an embrittling effect rather than promoting ductility. In particular, it causes embrittlement if the alloy is exposed to prolonged annealing at temperatures in the range from 350 to 500° C. Furthermore, it is known that in carbon steels nickel improves the ductility but tends to reduce the resistance to heat at elevated temperatures. This is related to a reduced carbide stability in nickel-containing steels. By contrast, the effect of cobalt on the combination of resistance to heat and ductility is relatively unknown even in carbon-containing 9–12% chromium steels.

The invention is based on the object of providing a martensitic-hardenable heat-treated steel with high ductility which compared to the known prior art, in particular the steel X12CrNiMo12, is distinguished by a high resistance to heat at temperatures of from 300 to 600° C. It is intended firstly to specify a suitable steel composition and secondly a heat treatment process for materials of this composition which allows a ductile and, at the same time, heat-resistant martensitic tempered microstructure to be formed.

The essence of the invention is a martensitic-hardenable heat-treated steel, having the following composition (data in % by weight): 9 to 13% Cr, 0.001 to 0.25% Mn, 2 to 7% Ni, 0.001 to 8% Co, at least one of W and Mo in total between 0.5 and 4%, 0.5 to 0.8% V, at least one of Nb, Ta, Zr and Hf in total between 0.001 and 0.1%, 0.001 to 0.05% Ti, 0.001 to 0.15% Si, 0.01 to 0.1% C, 0.12 to 0.18% N, at most 0.025% P, at most 0.015% S, at most 0.01% Al, at most 0.0012% Sb, at most 0.007% Sn, at most 0.012% As, remainder iron and customary impurities, and the proviso that the ratio by weight of vanadium to nitrogen V/N lies in the range between 3.5 and 4.2.

Preferred ranges for the individual alloying elements of the composition according to the invention are given in the subclaims.

The heat treatment process for the alloy according to the invention is characterized by the following steps:

Solution annealing at 1050 to 1250° C., followed by cooling to a temperature below 300° C., Tempering treatment, partial or complete reaustenitization at 600 to 900° C., Cooling to a temperature below 300° C., Annealing at a temperature of from 550 to 650° C.

The advantage of the invention consists in the fact that in said alloy a tempered microstructure which is distinguished by a tough basic matrix and by the presence of nitrides which produce resistance to heat is established. The toughness of the basic matrix is established by the presence of substitution elements, preferably by nickel and secondarily by cobalt. The contents of these substitution elements are determined in such a way that they allow both the martensitic hardening and the particle hardening by special nitrides, preferably vanadium nitrides, to proceed optimally in order to establish the highest possible resistance to heat.

In the known martensitic-hardenable 9–12% chromium steels, it is possible to establish a good combination of resistance to heat and ductility by means of a heat treatment which involves an austenitization treatment, a quenching treatment and a tempering treatment. The strength which can be achieved is in this case decisively limited by the basic hardness of the quenched martensite and the potential particle hardening action of precipitation phases which are formed during the tempering treatment. By means of a tempering treatment in the "secondary hardening range", it is possible to increase the strength beyond the basic hardness of the quenched martensite. This secondary hardening range, for the 12% chromium steels which are well known in power plant engineering, lies in the temperature range between 450 and approximately 530° C.

In principle, both hardening mechanisms, i.e. both martensitic hardening and precipitation hardening, reduce the ductility. A minimum ductility is characteristically observed in the secondary hardening range. This ductility minimum need not be caused only by the actual precipitation hardening mechanism. A certain contribution to embrittlement may also be made by segregation of impurities at the grain boundaries or possibly also by short-range order positions of dissolved alloying atoms being formed.

An increase in the tempering temperature to beyond the secondary hardening range leads to complete precipitation with considerable growth of carbides. As a result, the strength falls and the ductility rises. It is significant that as a result of the simultaneous recovery of the dislocation substructure and the particle coarsening, the ductility increases to a greater extent, so that overall the combination of strength and ductility is improved. This improvement is attributable to the formation of a particle-stabilized subgrain structure. Ductile structures are formed in the low-nickel 9–13% chromium steels as a result of a tempering treatment at over 700° C. In this context, it is to be assumed that both the ductility and the strength of particle-stabilized subgrain structures are reduced by nonuniformities in the topology of the particle subgrain structure. Precipitations at subgrain boundaries are subject to accelerated coarsening and tend to coagulate with adjacent precipitations. Coarse and coagulated phases generate fracture-initiating stress peaks which reduce ductility. Above all, however, the uneven distribution of the precipitations also considerably restricts the hardening mechanism which is most effective at high temperatures, namely the particle hardening.

It is possible to achieve an increase in ductility of restricted effect by reducing the grain size. However, in the alloys which are known in the prior art, this can only be implemented in large components with difficulty using forging techniques and leaves behind little effect. A somewhat more significant measure for increasing ductility in conventional, martensitic-hardenable steels is the addition of nickel to the alloy. However, the reasons of action of this measure are not known on all points and must be very dependent on the nickel content. For example, low levels of nickel can still be highly ductility enhancing if, for example, the formation of delta-ferrite can be completely suppressed as a result. By contrast, at nickel contents of over 2% by weight, nickel reduces the Ac1 temperature (which is the temperature at which ferrite begins to transform in to austenite during heating) to temperatures of below 700° C. Therefore, if the strength is to be increased by lowering the tempering temperature to below 700° C., in the presence of high nickel contents a partial transformation of ferrite into austenite needs to be reckoned with during tempering. This is associated with a certain ductility-enhancing formation of new grains. However, on the other hand it is necessary to take into account that the carbide precipitation above the Ac1 temperature takes place only incompletely, since the solubility of the austenite-stabilizing element carbon is greater in the austenite than in the ferrite. Furthermore, the austenite which forms is not sufficiently stabilized, so that a greater volumetric proportion of the reformed austenite is subjected to a further martensitic transformation during the reverse cooling after the tempering. In addition to the two abovementioned active contributions of nickel to increasing ductility, a certain contribution to ductility can come from nickel in its action as substitution element in solid solution. In terms of electron theory, this can be explained by the fact that the element nickel feeds additional, free electrons into the iron lattice and thus makes the iron alloys even more "metallic".

In principle, conventional, martensitic-hardenable steels which are alloyed with nickel do not have any particular advantages, in terms of resistance to heat, over low-nickel alloys. This applies at least to test temperatures of over 500° C. and at elevated nickel contents could be related to the abovementioned reaustenitization during tempering. Furthermore, it is known that the addition of nickel to steels of this type makes the microstructure instability under long-term age-hardening conditions at elevated temperatures significantly more acute. This long-term microstructure instability is related to accelerated coarsening of the carbides.

Cobalt is an austenite-stabilizing element which is similar to nickel. Therefore, in solid solution an effect similar to that of nickel is to be expected in terms of ductility. However, from the chemical viewpoint a significant distinction needs to be drawn, in that cobalt promotes ferromagnetism and increases the Curie temperature. Since self-diffusion within the iron matrix increases suddenly when the Curie temperature is exceeded, in the event of the Curie temperature being exceeded all the diffusion-controlled recovery and coarsening processes are accelerated. Therefore, as a result of the Curie temperature increasing it is possible to expect that the ability to withstand tempering will improve. Cobalt-alloyed structures should therefore undergo delayed softening during the tempering treatment and should therefore allow an increased strength to be established. A further important fact is that cobalt reduces the Ac1 temperature to a considerably lesser extent, per percent by weight of alloying addition, than nickel.

Unlike nickel and cobalt, manganese lies on the left-hand side, next to iron, in the periodic system of the elements. It is a lower-electron element, with the result that its action in solid solution should be distinctly different from nickel and cobalt. Nevertheless, it is an austenite-stabilizing element which considerably reduces the Ac1 temperature but does not leave behind any positive effect, but rather more of an unfavorable effect, in the ductility.

Working on the basis of these established facts and hypotheses, the following draft alloy is proposed for the purpose of improving the combination of resistance to heat and ductility:

1) The alloy according to the invention is to have an effective grain-reforming behavior, so that finer grain and block structures can be produced by forging and normalizing (austenitization). This grain refining is to be produced by a dispersion of relatively insoluble nitrides which is produced by the addition of nitrogen to strong nitride-forming elements, such as vanadium, niobium, tantalum, titanium, hafnium and zirconium. The grain refining itself can make a contribution to the resistance to heat, provided that the grain and block structure established is well stabilized against coarsening by the nitrides. However, the decisive factor is that the beneficial effect of the grain refining on the ductility outweighs the negative effect of the coarser primary phases on the ductility.
2) An improved resistance to heat is ensured by a thermally stable precipitation phase which, in a small proportion by volume, i.e. with a low solubility and therefore a high resistance to coarsening, allows a maximum particle hardening effect per molar volume at elevated test temperatures. The preferred precipitation phase is to be of the same type as those nitrides which allow the grain size restriction under point 1.
3) The precipitation reactions are to proceed uniformly, so that the combination of ductility and resistance to heat is not impaired by coarse, film-like precipitations and the nonuniform distribution thereof at the grain and subgrain boundaries.
4) Nickel is to be added to the alloy, in order to utilize its ductility-enhancing effect as a substitution element and in order to reduce the Ac1 and Ac3 temperatures. This reduction in the transformation temperature allows the precipitation of nitrides at low austenitization temperatures after the material has been heated from room temperature to the age-hardening temperature.
5) The effect of cobalt as a complementary substitution element to nickel is to be utilized in order to increase ductility. Unlike nickel, it is to be utilized exclusively as a dissolved element and not for influencing phase transformations (ferrite/austenite). As a substitution element, it is also to improve the ability to withstand tempering.
6) It is to be possible to produce the desired alloy, in particular to introduce nitrogen, under the basic condition that the levels of elements which cause embrittlement, such as silicon and manganese, can be kept low in accordance with requirements.

It is known from EP 0 866 145 A2 that by a controlled addition of nitrogen, vanadium and further elements which form special nitrides, such as niobium, titanium, tantalum, zirconium and hafnium, the first three points can be fulfilled highly satisfactorily and can therefore be utilized for a steel alloying development with a view to improved mechanical properties. In this context, vanadium nitride plays a key role as it can be actively utilized both for grain refining and for precipitation hardening. The decisive factor is that a tempering treatment of steels of this type at temperatures of between 600 and 650° C. is able to significantly increase the resistance to heat compared to alloys which have been tempered in a similar way but are of conventional type. This is attributable to the precipitation hardening which is used, on account of the presence of vanadium nitrides in this temperature range, which was first observed, at a temperature of 700° C., by Göcmen, A. et al.: Precipitation Behavior and Stability of Nitrides in High Nitrogen Martensitic 9% and 12% Chromium Steels, ISIJ Int., 1996, 36, p. 769. It is important that in this case fine and dense precipitation states with a high cohesion of the vanadium nitrides with respect to the iron lattice were found. This is to conclude that a secondary hardening by means of vanadium nitrides at 600 to 650° C. does not offer any particular advantages in terms of ductility over conventional secondary hardening at 450 to 530° C.

The element manganese plays a further important role in the alloys according to the invention listed in document EP 0 866 145 A2. Therefore, the element manganese is of importance in particular in steels with a high nitrogen content, since it increases the solubility for nitrogen in the molten material and in the austenite matrix. Manganese has the further property of displacing the transformation peak of the austenite-ferrite transformation toward longer times. These properties of manganese result in favorable preconditions for the vanadium nitrides, after a solution annealing treatment, to be precipitated out again prior to the martensitic transformation in the range of metastable austenite. On the other hand, with regard to carbon-containing 12% chromium steels, manganese is understood as a contaminating element which significantly promotes tempering embrittlement. Therefore, the manganese content, in particular with regard to applications in the temperature range between 350 and 500° C., is usually restricted to extremely small quantities.

Substitution of manganese by nickel in 9–13% chromium steels with a high nitrogen content creates new advantages and options. It can be assumed that nickel, as a substitution element in solid solution, improves the ductility of the crystal matrix. Alloying with nickel further reduces the Ac1 and Ac3 temperatures. In N- and V-alloyed systems, this creates the advantage that vanadium nitrides can be precipitated at low austenitization temperatures, i.e. in an austenitic matrix. However, the decisive advantage is that the vanadium nitrides, which are inherently difficult to nucleate, can easily be nucleated in the martensitic, dislocation-rich matrix before they are transferred into the austenitic matrix. Therefore, if it is intended to precipitate the vanadium nitrides in finely dispersed form in the austenitic matrix, it is no longer necessary to carry out the age hardening immediately after the solution annealing treatment in the "metastable" austenite, as has been described in EP 0 866 145 A2. Since the nuclei for the vanadium nitrides can now easily be formed in the martensitic matrix, the age-hardening time for readying the nitrides in the austenite can be considerably shortened. The alloying with nickel therefore offers a new option for rapidly and effectively precipitating the vanadium nitrides in the austenitic matrix which is capable of transformation. Since the austenite hardening can now be carried out effectively without manganese, it is also possible to further improve the stability of the martensitic matrix with respect to tempering embrittlement, by considerably restricting the levels of manganese.

Furthermore, it should be taken into account that the alloy imposes a sufficiently high solubility for the preferred levels of nitrogen. It is known that manganese increases the solubility for nitrogen and nickel reduces the solubility for nitrogen. The particular advantage of the desired draft alloy lies in the fact that the required solubility for nitrogen is offered simply by means of the element vanadium, which is added to the alloy, in order to form an optimum microstructure, in a virtually stoichiometric ratio to nitrogen. The dominant effect of vanadium on the solubility of nitrogen makes it possible for the high and preferred levels of nitrogen, because of vanadium and virtually in stoichiometric proportions to vanadium, to be introduced without the application of excess pressure and therefore for these levels only to be impeded to a subordinate extent by the presence of nickel and cobalt.

The element cobalt furthermore offers the option of delaying the overaging of the nitrides and the recovery of the dislocations during tempering without increased austenite reversion being induced during the tempering.

The preferred quantities, in percent by weight, for each element and the reasons for the alloying ranges selected according to the invention in connection with the resultant heat treatment options are listed below.

Chromium

A proportion by weight of 9–13% chromium allows thick-walled components to be hardened thoroughly all the way through and ensures sufficient resistance to oxidation up to a temperature of 550° C. A proportion by weight of less than 9% impairs the ability of the material to be heat-treated all the way through. Levels above 13% lead to the accelerated formation of hexagonal chromium nitrides during the tempering operation, which in addition to nitrogen also bond vanadium and thus reduce the efficiency of age-hardening by vanadium nitrides. The optimum chromium content is 10.5 to 11.5%.

Manganese and Silicon

Together with silicon, these elements promote tempering embrittlement and therefore must be restricted to the lowest possible levels. The range to be specified should, in view of the metallurgical possibilities in the ladle, lie in the range between 0.001 and 0.25% for manganese and between 0.001 and 0.15% for silicon.

Nickel

Nickel is used as a austenite-stabilizing element to suppress delta-ferrite. Furthermore, as a dissolved element in the ferritic matrix it is to improve ductility. Nickel contents of up to approximately 3.5% by weight remain homogeneously dissolved in the matrix if the tempering temperature or the stress-relief annealing temperature to conclude the overall heat treatment does not exceed 600° C. For alloys which are to be tempered at low temperatures, i.e. at 600 to 640° C., a preferred nickel content is 3 to 4% by weight. Nickel contents of over 4% by weight increase the austenite stability to such an extent that there may be an elevated proportion of residual austenite or temper austenite in the heat-treated martensite after the solution annealing and tempering. However, a special heat treatment is recommended for the steels with a high nickel content in the presence of stoichiometric nitrogen and vanadium contents. If an alloy of this type is solution-annealed at high temperatures, for example at 1150 to 1200° C., an elevated residual austenite content after tempering is attributable to the action of the high nitrogen and vanadium concentrations in solution on the resultant increase in the martensite start temperature. However, renewed reaustenitization at temperatures of between 700 and 850° C. allows further precipitation of vanadium nitrides, which is able to raise the martensite start temperature again, in such a manner that complete retransformation into martensite becomes possible again through quenching. Low reaustenitization temperatures of this nature prevent premature overaging of the vanadium nitrides, so that they are still able to make a significant contribution to particle hardening. This process allows a martensite which is well stabilized with vanadium nitrides to form, allowing a particularly high ductility to be established through the preceding process of forming new grains. A further tempering treatment at approximately 600° C. leads to the formation of small austenite islands which are sufficiently stabilized with regard to retransformation into martensite. The proportion of this austenite by volume is less than 5%, provided that the nickel content does not exceed 7%. Higher proportions by volume increase the risk of embrittlement during long-term age-hardening at elevated temperatures. This type of heat treatment is suitable for alloys containing 2 to 7% nickel. A particularly good combination of resistance to heat and ductility is achieved, taking into account this specific heat treatment technique, with nickel contents in the range between 4.5 and 6.5%.

Cobalt

This element is used as substitution element for iron in solid solution for the final fine adaptation of ductility and resistance to heat. A proportion by weight of up to 10% cobalt can be added to the alloy without austenite transformation being expected at tempering temperatures in the range from 600 to 650° C. The optimum cobalt content depends on the quantitative proportion of molybdenum and tungsten. The addition of cobalt in levels of above about 8% by weight has proven uneconomical. A preferred alloying range which takes into account the high alloying costs of cobalt is 3.5 to 4.5% by weight.

Molybdenum and Tungsten

Both elements improve the creep strength by solid-solution hardening as partially dissolved elements and by precipitation hardening during long-term loading. However, an excessively high proportion of these elements leads to embrittlement during long-term age hardening, which results from the precipitation and coarsening of Laves phase (W, Mo) and sigma phase (Mo). For this reason, the total proportion of Mo+W must be limited to 4%. An ideal range for W+Mo lies in the range from 1 to 4%. Molybdenum is preferred to tungsten on account of its higher solubility. A preferred range is given by a molybdenum content in the range from 1 to 2% and a tungsten content of less than 1%. A molybdenum content of from 1 to 2.5% and a tungsten content of less than 0.5% is better. A particularly preferred range is given by a negligibly small tungsten content but molybdenum contents of from 1 to 3%.

Vanadium and Nitrogen

These two elements together decisively control the grain size formation and the precipitation hardening. The microstructure forms which evolve are optimum if the elements vanadium and nitrogen are alloyed in a virtually stoichiometric ratio with respect to one another. The ideal weight ratio of V/N is 3.6. Since the nitrogen solubility is improved by vanadium, a slightly superstoichiometric V/N ratio is to be aimed at. A slightly superstoichiometric ratio in some cases also increases the stability of vanadium nitride with respect to chromium nitride. Overall, a V/N ratio in the range between 3.5 and 4.2 is preferred. A particularly preferred range is 3.8 to 4.2. The concrete level of nitrogen and vanadium nitrides depends on the optimum volumetric proportion of the vanadium nitrides which are to remain as insoluble primary nitrides during the solution annealing. The greater the overall proportion of vanadium and nitrogen, the greater the proportion of vanadium nitrides which no longer dissolve and the greater the grain-refining action. However, the positive influence of the grain refining on the ductility is limited, since with an increasing volumetric proportion of primary nitrides the primary nitrides themselves limit the ductility. The preferred nitrogen content lies in the range from 0.13 to 0.18% by weight, and the preferred vanadium content lies in the range between 0.5 and 0.8% by weight.

Titanium

Titanium nitride is a relatively insoluble nitride which assists grain refining. Unlike vanadium nitride, however, it can form even in the molten phase and in particular in the solidification phase, so that overall the solidification takes place more smoothly and finely. However, excessively high proportions by weight lead to very large primary nitrides which have an adverse effect on the ductility. Therefore, the upper titanium content must be limited to 0.05%.

Niobium, Tantalum, Zirconium and Hafnium:

These are all strong nitride-forming elements which assist the grain refining action. To keep the volumetric proportion of the primary nitride at a low level, the total proportion of these elements must be restricted to 0.1%. A particularly preferred nitride-forming element is niobium, since niobium dissolves in the vanadium nitride in small amounts and is thus able to improve the stability of the vanadium nitride. Niobium is preferably added to the alloy in the range between 0.01 and 0.07%.

Phosphorus, Sulfur, Arsenic, Antimony and Tin

Together with silicon and manganese, these elements intensify tempering embrittlement during long-term age hardening in the range between 350 and 500° C. These elements should therefore be restricted to minimum tolerable proportions.

Aluminum

This element is a strong nitride-forming element which bonds nitrogen even in the molten state and therefore considerably impairs the activity of the nitrogen in the alloy. The aluminum nitrides which are formed in the melt are very coarse and reduce ductility. Therefore, aluminum must be restricted to a proportion of 0.01% by weight.

Carbon

Carbon forms chromium carbides during tempering, which are of benefit for an improved creep strength. However, if the carbon contents are too high, the resultant increased volumetric proportion of carbides leads to a fall in ductility which, in particular because of the carbide coarsening, comes to bear during long-term age hardening. Therefore, the carbon content should be limited to a maximum of 0.1%. Another drawback is the fact that carbon reinforces the age hardening during welding. The particularly preferred carbon content lies in the range between 0.02 and 0.07% by weight.

A number of exemplary embodiments of the invention are illustrated in the drawing, in which.

The invention is explained in more detail below with reference to exemplary embodiments and FIGS. 1 to 5.

Table 1 shows a series of alloys according to the invention.

With the exception of the alloys AP35 and AP38, which were melted as 10 kg melting batches in an induction furnace, all the other alloys were produced in the form of 60–80 kg electrodes using the electroslag remelting process. Furthermore, with the exception of the alloys AP28M, no excess pressure was applied when establishing the specified nitrogen content during the melting or during the remelting process. These alloys were therefore melted or remelted at 0.9 bar (atmospheric pressure). The resultant nitrogen analyses (Table 1) demonstrate that the preferred nitrogen contents, even with high nickel contents (up to 5.5%), can be introduced without excess pressure during production.

The following heat treatments provide a framework with regard to solution-annealing and tempering (reaustenitization) temperature, within which the heat treatments were carried out:

W2

Solution annealing at 1080° C./2 h/air cooling to room temperature

Tempering treatment at 640° C./2 h/air cooling to room temperature

Stress-relief annealing at 600° C./1 h

W4

Solution annealing at 1180° C./2 h/air cooling to room temperature

Tempering treatment at 640° C./2 h/air cooling to room temperature

Stress-relief annealing at 600° C./1 h

T2C

Solution annealing at 1180° C./2 h/air cooling to room temperature

Reaustenitization at 750° C./2 h/air cooling to room temperature

Stress-relief annealing at 600° C./1 h

In all the other heat treatments, the solution-annealing and tempering temperatures were at most changed in such a way that they still lay between those of W2, W4 and T2C. Forged blocks with cross-sectional dimensions of 7×7 $cm^2$ were used for the heat treatment.

Figure 1:
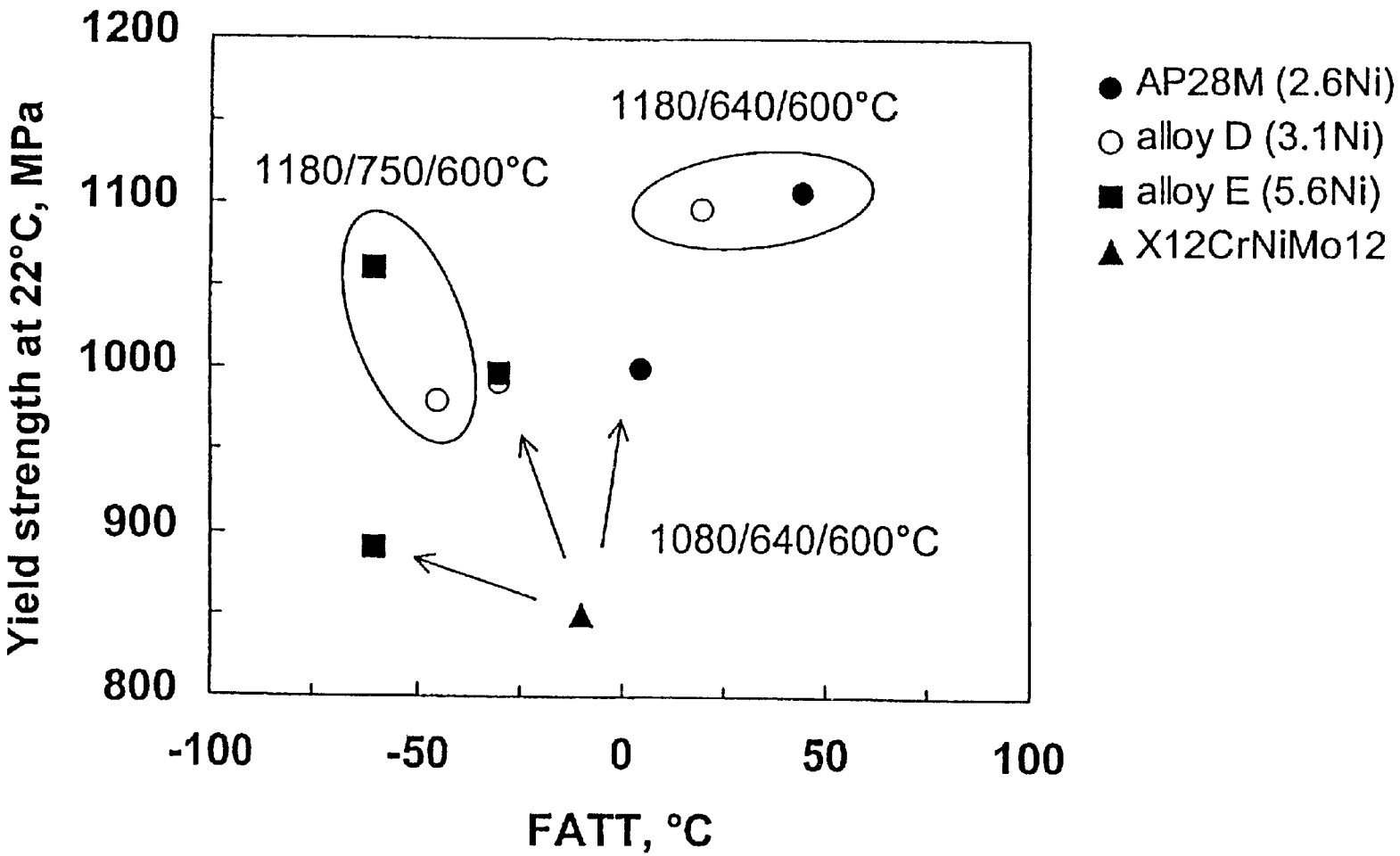
FIG. 1 shows a graph in which the yield strength of selected alloys at room temperature is plotted as a function of the fracture appearance transition temperature (FATT) and the effect of nickel and of the heat treatment temperatures on the yield strength and on FATT can be established.

FIG. 1 shows the combination of yield strength at room temperature and fracture appearance transition temperature (FATT) which can be established for three different alloys according to the invention, namely AP28M, "alloy D" and "alloy E", which are all alloyed with 4% by weight cobalt and otherwise differ from one another primarily with regard to the nickel content. The results are compared with those of a commercial alloy of type X12CrNiMo12 which has been solution-annealed at 1060° C., tempered at 640° C. and stress-relief annealed at 600° C. Fundamentally, it can be seen that improved yield strength values and/or ductilities can be achieved by means of the selected alloys. The decisive observation is that the combination of yield strength and ductility which can be achieved can be sensitively influenced both by the nickel content and by the solution-annealing temperature. It can be seen clearly from FIG. 1 that by increasing the solution-annealing temperature it is possible to effectively improve the yield strength, but at the expense of a reduced ductility. Furthermore, it can be seen clearly from FIG. 1 that by increasing the nickel content the ductility can be improved effectively, but at the expense of strength. The combination of the two observations results in new options, by optimizing the nickel content on the one hand and by optimizing the heat treatment on the other hand, of establishing alloys with improved strength and ductility properties. With regard to a simple heat treatment (W2: 1080° C./640° C./600° C.), an optimum combination of resistance to heat and ductility is achieved with nickel contents in the range between 3 and 3.5%. An extraordinarily good combination of yield strength and ductility can be established in particular with alloys with a high nickel content ("alloy E") by means of a two-stage austenitization treatment at 1180 and 750° C. This favorable combination of properties is made possible by the low Ac3 temperature of the alloy with a high nickel content. It can thus be assumed that in alloys with nickel contents of 5.5% by weight, the matrix is almost completely austenitic at 750° C. This means that a high volumetric proportion of vanadium nitrides which has been dissolved at 1180° C. can be reprecipitated in the austenite during the subsequent annealing treatment at 750° C. Alloying with nickel can clearly be utilized successfully in order, after a solution-annealing treatment and quenching to room temperature, to introduce an age-hardening annealing at lower austenitization temperatures before the heat treatment is continued with the conventional quenching and tempering treatment.

Figure 2:
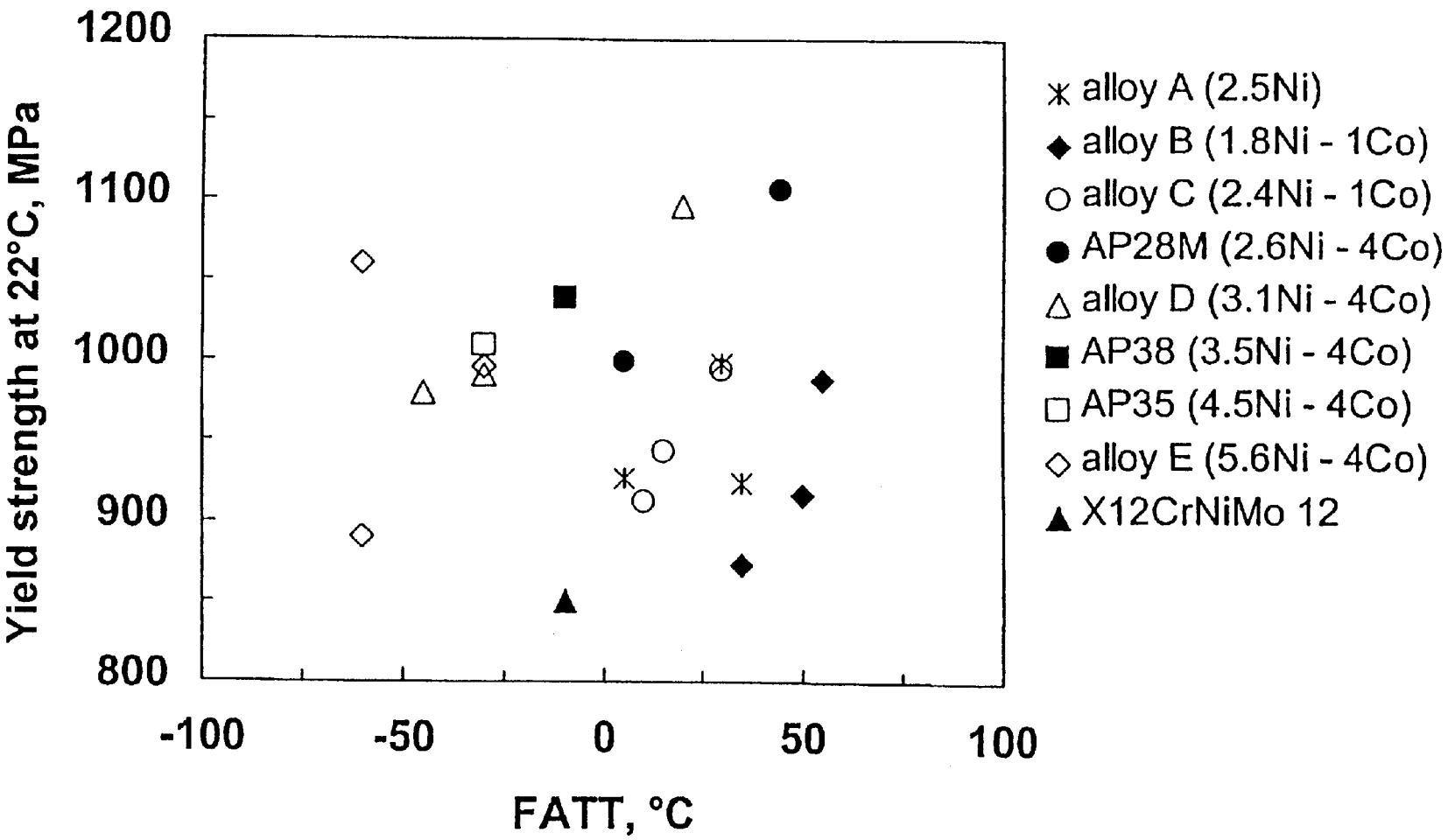
FIG. 2 shows a graph in which the yield strength of selected alloys at room temperature is plotted as a function of the fracture appearance transition temperature (FATT) and the effect of nickel and of cobalt on the yield strength and on FATT can be established.

FIG. 2 uses various alloys to demonstrate the effect of cobalt on the combination of yield strength at room temperature and the fracture appearance transition temperature FATT. In this example, various heat treatments with solution-annealing temperatures of between 1080 and 1200° C., tempering temperatures of between 640 and 750° C. and a final stress-relief annealing treatment at 600° C. were tested. It can be seen clearly that all the alloys with low cobalt contents lie in the lower quadrant with low yield strength values and high FATT values, i.e. are considerably inferior to similar alloys with high cobalt contents with regard to the combination of yield strength and ductility which can be established.

Figure 3:
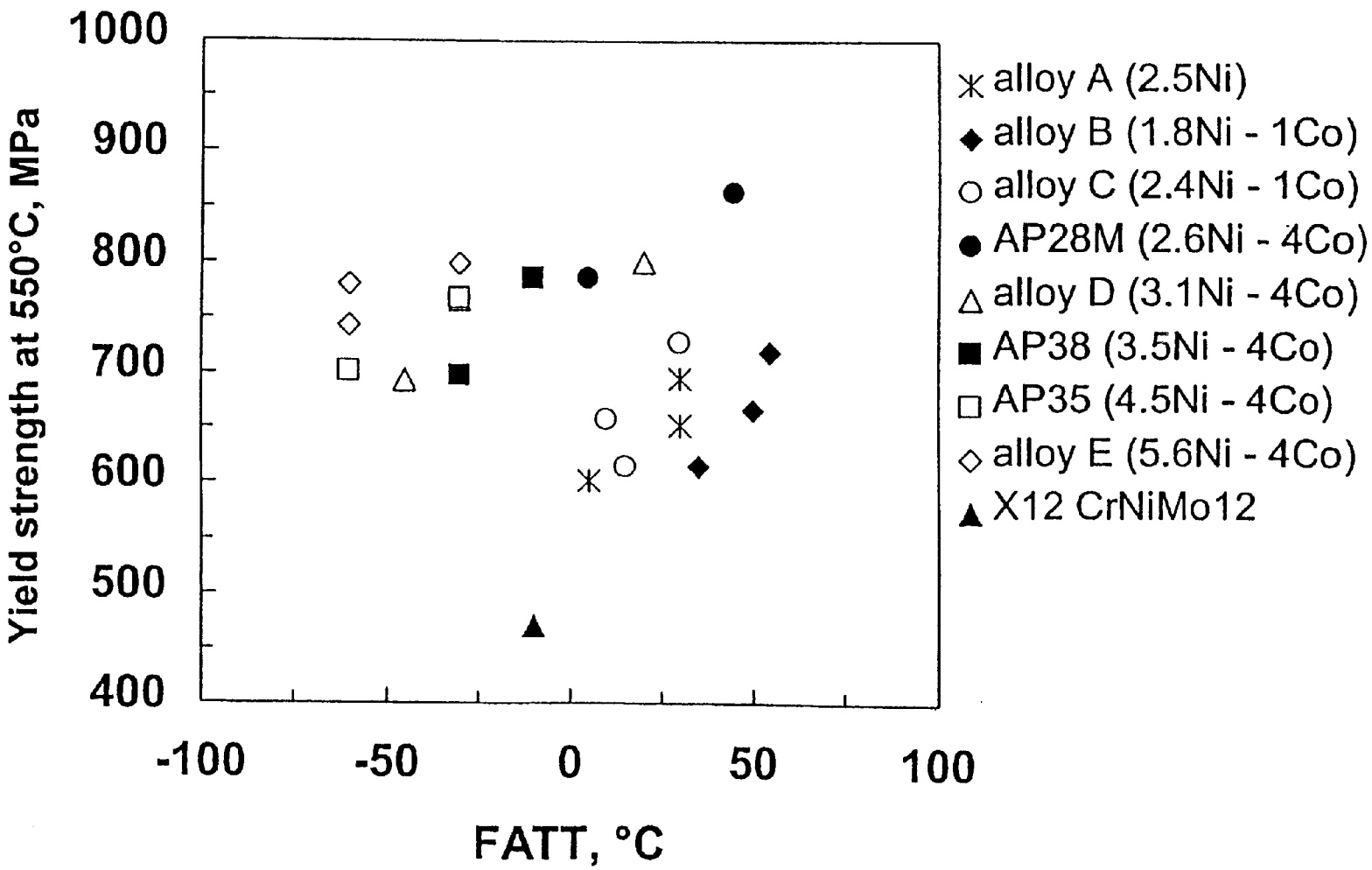
FIG. 3 shows a graph in which the yield strength of selected alloys at a test temperature of 550° C. is plotted against the fracture appearance transition temperature (FATT) and the effect of nickel and of cobalt on the yield strength at 550° C. and on FATT can be established.

FIG. 3 illustrates, in a similar manner to the results at room temperature illustrated in FIG. 2, the test results on the same alloys (same heat treatment) but takes into account the hot yield strength at 550° C. Alloys with cobalt, e.g. AP28M, offer a significantly improved combination of the hot yield strength at 550° C. and the fracture appearance transition temperature compared to alloys without cobalt, e.g. "alloy A". The best properties are achieved with a two-stage solution-annealing treatment (1180° C., 750° C).

Figure 4:
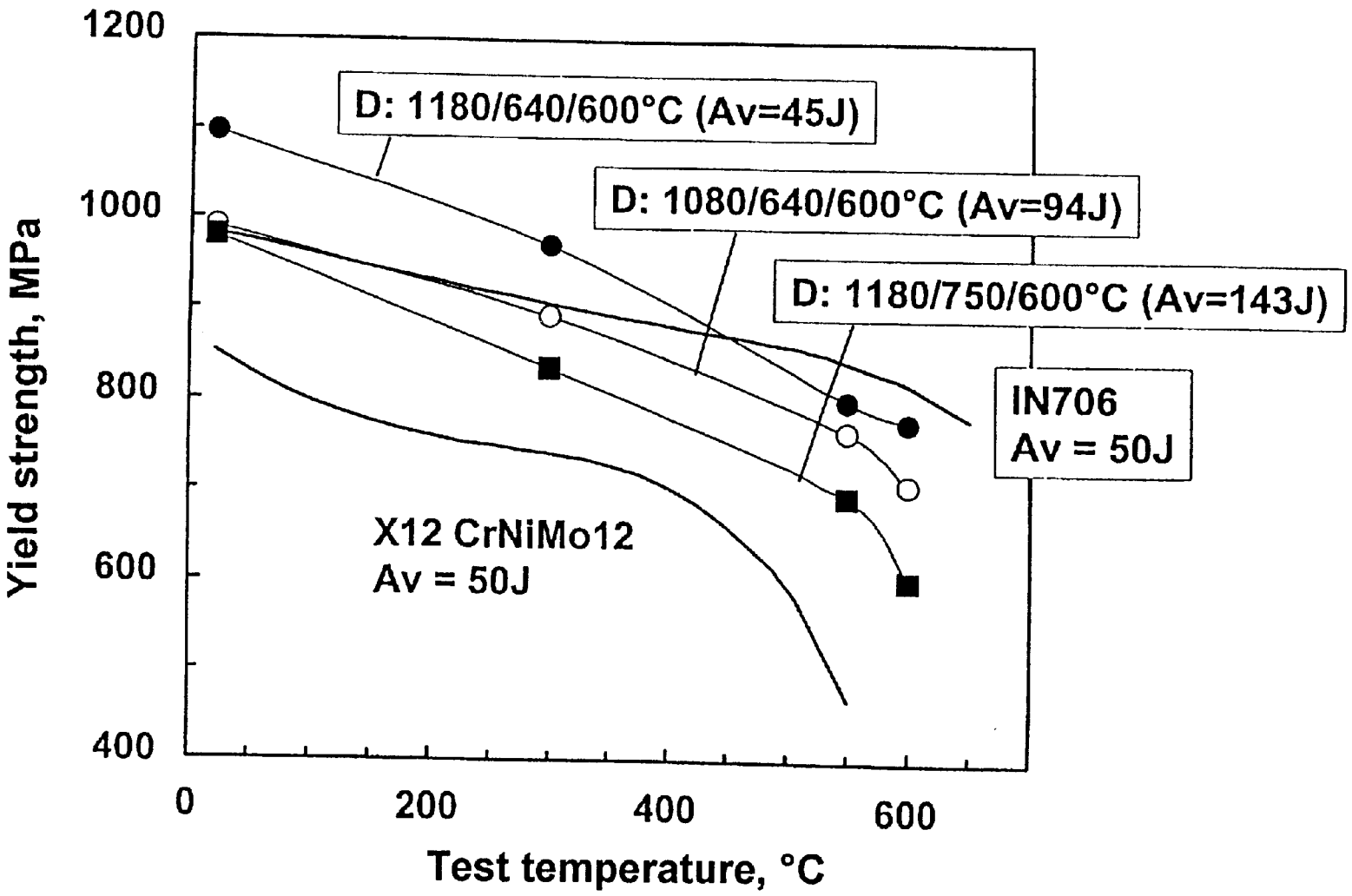
FIG. 4 shows a graph in which the yield strength of the alloy according to the invention "alloy D" resulting from various heat treatments, together with the comparison alloys X12CrNiMo12 (martensitic-hardenable steel) and IN706 (precipitation-hardenable Ni—Fe alloy) and the associated notched-impact energies Av is plotted against the test temperature.
Figure 5:
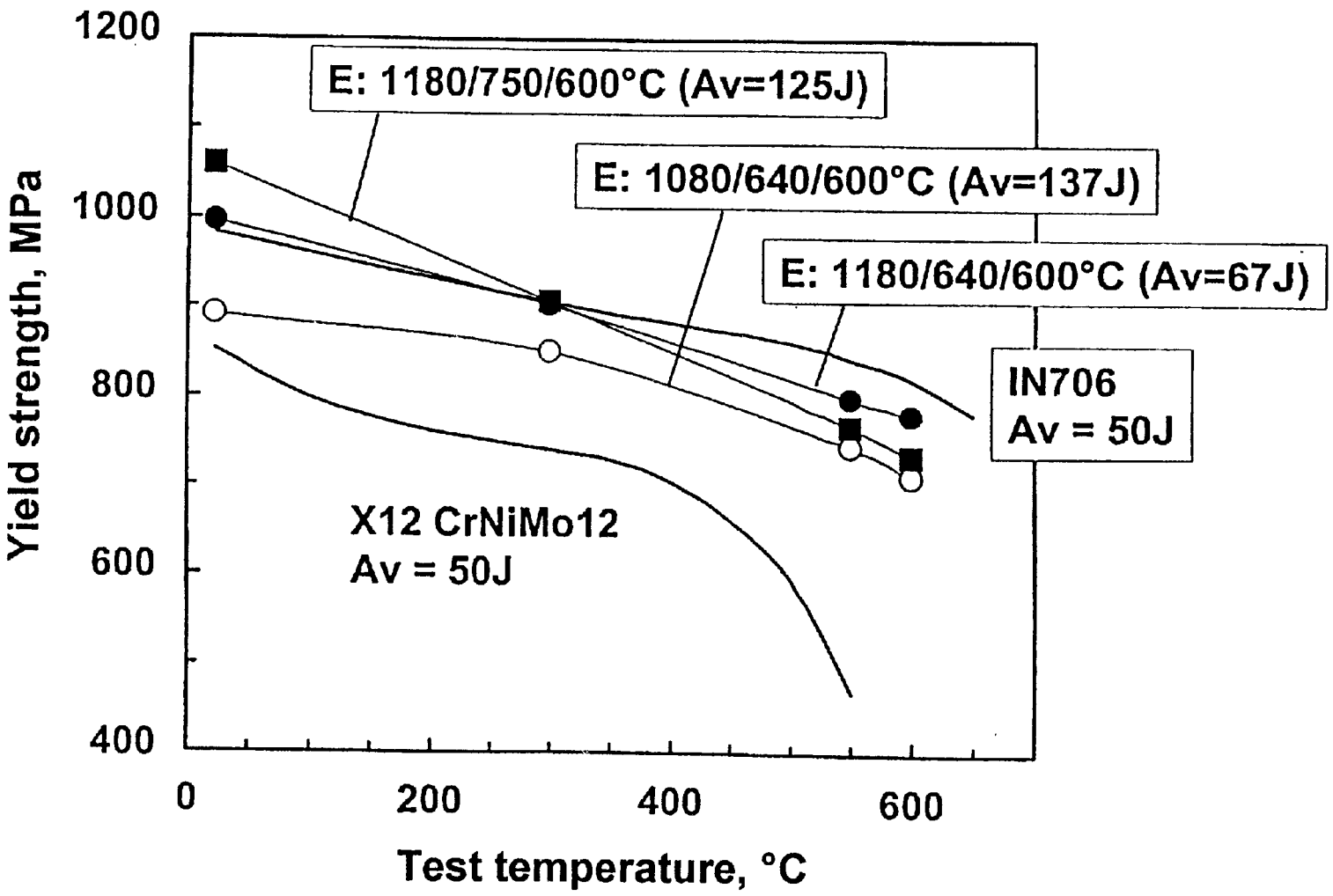
FIG. 5 shows a graph in which the yield strength of the alloy according to the invention "alloy E" resulting from different heat treatments, together with the comparison alloys X12CrNiMo12 (martensitic-hardenable steel) and IN706 (precipitation-hardenable Ni—Fe alloy) and the associated notched-impact energies Av, is plotted against the test temperature.

FIGS. 4 and 5 show graphs in which the yield strength of the alloys according to the invention "alloy D" and "alloy E" as a function of the heat treatment carried out is plotted against the test temperature. Furthermore, the yield strengths of the comparison alloys X12CrNiMo12 (martensitic-hardenable steel) and IN706 (precipitation-hardenable alloy), as well as their notched-impact energies Av, are included in the drawing for comparison with the alloys according to the invention. It can be seen that for the alloys according to the invention "alloy D" and "alloy E", an improvement in the resistance to heat is maintained up to high test temperatures, independently of the heat treatment and independently of the nickel content. The novel alloys according to the invention, compared to austenitic high-temperature alloys (IN706) which are designed on a nickel-iron base, present an extremely good combination of notched-impact energy at room temperature and heat strength at 550° C.

Naturally, the invention is not restricted to the exemplary embodiments described.

TABLE 1

| Weight Production in % by weight | X12CrNiMo12 ESU | AP28M 80 kg DESU | AP35 10 kg | AP38 10 kg | alloyA 60 kg ESU | alloyB 60 kg ESU | alloyC 60 kg ESU | alloyD 60 kg ESU | alloyE 60 kg ESU |
|---|---|---|---|---|---|---|---|---|---|
| Cr | 11.5 | 11.9 | 10.2 | 10.1 | 10.7 | 10.8 | 10.4 | 11.2 | 11.2 |
| Mn | <0.25 | 0.04 | 0.18 | 0.21 | 0.1 | 0.07 | 0.07 | 0.05 | 0.04 |
| Ni | 2.3 | 2.6 | 4.4 | 3.4 | 2.5 | 1.8 | 2.4 | 3.1 | 5.6 |
| Co | | 4 | 3.9 | 4.1 | <0.02 | 1.0 | 1.0 | 4.0 | 4.0 |
| Mo | 1.5 | 1.49 | 1.5 | 1.6 | 1.5 | 1.4 | 1.8 | 1.8 | 1.8 |
| V | 0.25 | 0.66 | 0.65 | 0.64 | 0.51 | 0.53 | 0.52 | 0.61 | 0.58 |
| Nb | | 0.04 | 0.04 | 0.04 | 0.03 | 0.03 | 0.03 | 0.028 | 0.031 |
| Ti | | 0.03 | 0.03 | 0.03 | <0.02 | <0.02 | <0.02 | <0.02 | <0.02 |

TABLE 1-continued

| Weight Production in % by weight | X12CrNiMo12 ESU | AP28M 80 kg DESU | AP35 10 kg | AP38 10 kg | alloyA 60 kg ESU | alloyB 60 kg ESU | alloyC 60 kg ESU | alloyD 60 kg ESU | alloyE 60 kg ESU |
|---|---|---|---|---|---|---|---|---|---|
| Si | <0.15 | 0.15 | <0.05 | <0.05 | <0.02 | <0.02 | <0.02 | <0.02 | <0.02 |
| C | 0.12 | 0.036 | 0.042 | 0.039 | 0.058 | 0.065 | 0.065 | 0.042 | 0.035 |
| N | 0.035 | 0.18 | 0.15 | 0.15 | 0.16 | 0.16 | 0.15 | 0.156 | 0.159 |

What is claimed is:

1. A martensitic-hardenable heat-treated steel, characterized by the following composition (data in % by weight): 9 to 13% Cr, 0.001 to 0.25% Mn, 2 to 7% Ni, 0.001 to 8% Co, at least one of W and Mo in total between 0.5 and 4%, 0.5 to 0.8% V, at least one of Nb, Ta, Zr and Hf in total between 0.001 and 0.1%, 0.001 to 0.05% Ti, 0.001 to 0.15% Si, 0.01 to 0.1% C, 0.12 to 0.18% N, at most 0.025% P, at most 0.015% S, at most 0.01% Al, at most 0.0012% Sb, at most 0.007% Sn, at most 0.012% As, remainder iron and customary impurities, and the proviso that the ratio by weight of vanadium to nitrogen V/N lies in the range between 3.5 and 4.2.

2. The martensitic-hardenable heat-treated steel as claimed in claim 1, characterized by 2 to 4.5% Ni.

3. The martensitic-hardenable heat-treated steel as claimed in claim 1, characterized by 2.7 to 3.7% Ni.

4. The martensitic-hardenable heat-treated steel as claimed in claim 1, characterized by 4 to 7% Ni.

5. The martensitic-hardenable heat-treated steel as claimed in claim 1, characterized by 4.5 to 6.5% Ni.

6. The martensitic-hardenable heat-treated steel as claimed in claim 1, characterized by 0.5 to 6% Co.

7. The martensitic-hardenable heat-treated steel as claimed in claim 6, characterized by 2 to 6% Co.

8. The martensitic-hardenable heat-treated steel as claimed in claim 6, characterized by 3.5 to 4.5% Co.

9. The martensitic-hardenable heat-treated steel as claimed in claim 1, characterized by 10 to 12% Cr.

10. The martensitic-hardenable heat-treated steel as claimed in claim 9, characterized by 10.5 to 11.5% Cr.

11. The martensitic-hardenable heat-treated steel as claimed in claim 1, characterized by 0.2 to 0.07% C.

12. The martensitic-hardenable heat-treated steel as claimed in claim 1, characterized by 0.5 to 0.7% V and 0.14 to 0.17% N.

13. The martensitic-hardenable heat-treated steel as claimed in claim 1, characterized by 0.1 to 0.7% Nb.

14. The martensitic-hardenable heat-treated steel as claimed in claim 1, characterized by a total of Mo and W which lies in the range between 1 and 4%.

15. The martensitic-hardenable heat-treated steel as claimed in claim 14, characterized by less than 1% W and a total of Mo and W which lies in the range between 1 and 2.5%.

16. The martensitic-hardenable heat-treated steel as claimed in claim 15, characterized by less than 0.5% W and a total of Mo and W which lies in the range between 1 and 2.5%.

17. A process for the heat treatment of a steel having a composition as set forth in claim 1, characterized by the following successive process steps:

Solution annealing at 1050 to 1250° C.,

Cooling to a temperature below 300° C.,

Tempering treatment, partial or complete reaustenitization at 600 to 900° C.,

Cooling to a temperature below 300° C.,

Annealing at a temperature of from 550 to 650° C.

* * * * *